US009164490B1

(12) United States Patent
Fraser

(10) Patent No.: US 9,164,490 B1
(45) Date of Patent: Oct. 20, 2015

(54) CHRONOGRAPH ASSEMBLY

(71) Applicant: William A. Fraser, Glenwood, FL (US)

(72) Inventor: William A. Fraser, Glenwood, FL (US)

( * ) Notice: Subject to any disclaimer, the term of this patent is extended or adjusted under 35 U.S.C. 154(b) by 0 days.

(21) Appl. No.: 14/471,415

(22) Filed: Aug. 28, 2014

(51) Int. Cl.

| | |
|---|---|
| ***G04C 21/14*** | (2006.01) |
| *G04C 21/12* | (2006.01) |
| *G04B 23/10* | (2006.01) |
| *G04G 13/02* | (2006.01) |

(52) U.S. Cl.
CPC ..... *G04C 21/14* (2013.01); *G04B 23/10* (2013.01); *G04C 21/12* (2013.01); *G04G 13/02* (2013.01)

(58) Field of Classification Search
CPC ..... G04C 21/12; G04C 21/14; G04G 13/02; G04B 23/10
USPC ..... 368/63
See application file for complete search history.

(56) References Cited

U.S. PATENT DOCUMENTS

| | | | | |
|---|---|---|---|---|
| D212,962 | S | 12/1968 | McLeod | |
| 3,507,110 | A | 4/1970 | Milatz | |
| 3,835,640 | A | 9/1974 | Hughes, Jr. | |
| 4,531,841 | A | 7/1985 | Puff | |
| 5,293,356 | A | 3/1994 | Chin-Hsing | |
| D365,763 | S | 1/1996 | Mateer | |
| 6,962,494 | B1 | 11/2005 | Olson | |
| 6,967,900 | B2 * | 11/2005 | Chapman | 368/10 |
| 7,187,625 | B2 * | 3/2007 | Riggi | 368/73 |
| 7,336,565 | B2 | 2/2008 | Rohrbacker et al. | |
| 7,376,051 | B2 | 5/2008 | Rosen | |
| 2006/0153007 | A1 * | 7/2006 | Chester | 368/12 |
| 2006/0175288 | A1 * | 8/2006 | Aratake | 216/41 |
| 2006/0280036 | A1 * | 12/2006 | Hegarty | 368/73 |

* cited by examiner

*Primary Examiner* — Sean Kayes

(57) ABSTRACT

A chronograph assembly for emitting an audible message at the top of each hour includes a clock structured to have a pair of hands indicating a time of day. The clock is coupled to a support surface. A processor is coupled to the clock. An electronic memory is coupled to the clock and the processor. The electronic memory stores a recorded audible message comprising the words "It's five o'clock somewhere". A control is coupled to the clock and the electronic memory. The control selects an aural quality of the recorded audible message. A speaker is coupled to the clock and the processor. A sensor is coupled to the clock and the processor. The sensor detects a position of the hands on the clock. The processor is actuated when the hands are positioned in a trigger position. The speaker emits the recorded audible message when the processor is actuated.

10 Claims, 3 Drawing Sheets

CHRONOGRAPH ASSEMBLY

BACKGROUND OF THE DISCLOSURE

Field of the Disclosure

The disclosure relates to chronograph devices and more particularly pertains to a new chronograph device for emitting an audible message at the top of each hour.

SUMMARY OF THE DISCLOSURE

An embodiment of the disclosure meets the needs presented above by generally comprising a clock structured to have a pair of hands indicating a time of day. The clock is coupled to a support surface. A processor is coupled to the clock. An electronic memory is coupled to the clock. The electronic memory is electrically coupled to the processor. The electronic memory stores a recorded audible message. The recorded audible message comprises the words "It's five o'clock somewhere". A control is coupled to the clock. The control is electrically coupled to the electronic memory. The control selects an aural quality of the recorded audible message. A speaker is coupled to the clock. The speaker is electrically coupled to the processor. A sensor is coupled to the clock. The sensor detects a position of the hands on the clock. The sensor is electrically coupled to the processor. The processor is actuated when the hands are positioned in a trigger position. The speaker emits the recorded audible message when the hands are positioned in the trigger position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
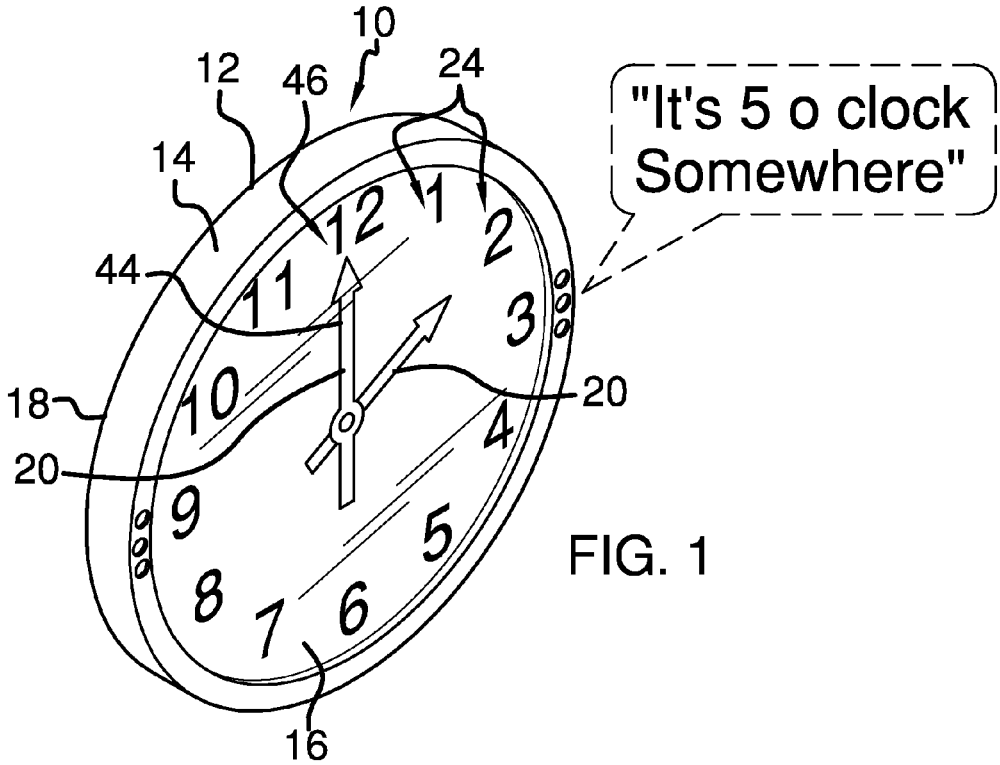
FIG. 1 is a perspective view of a chronograph assembly according to an embodiment of the disclosure.
Figure 2:
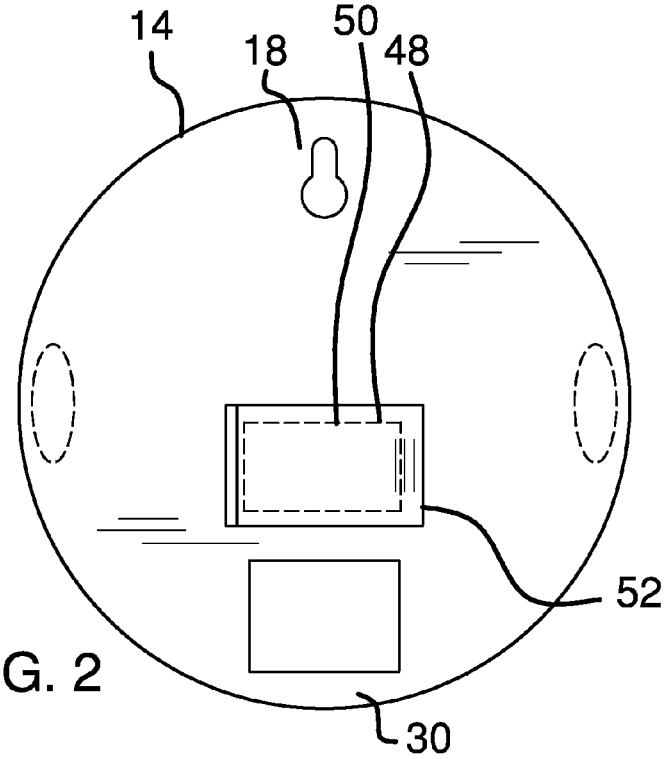
FIG. 2 is a back view of an embodiment of the disclosure.
Figure 3:
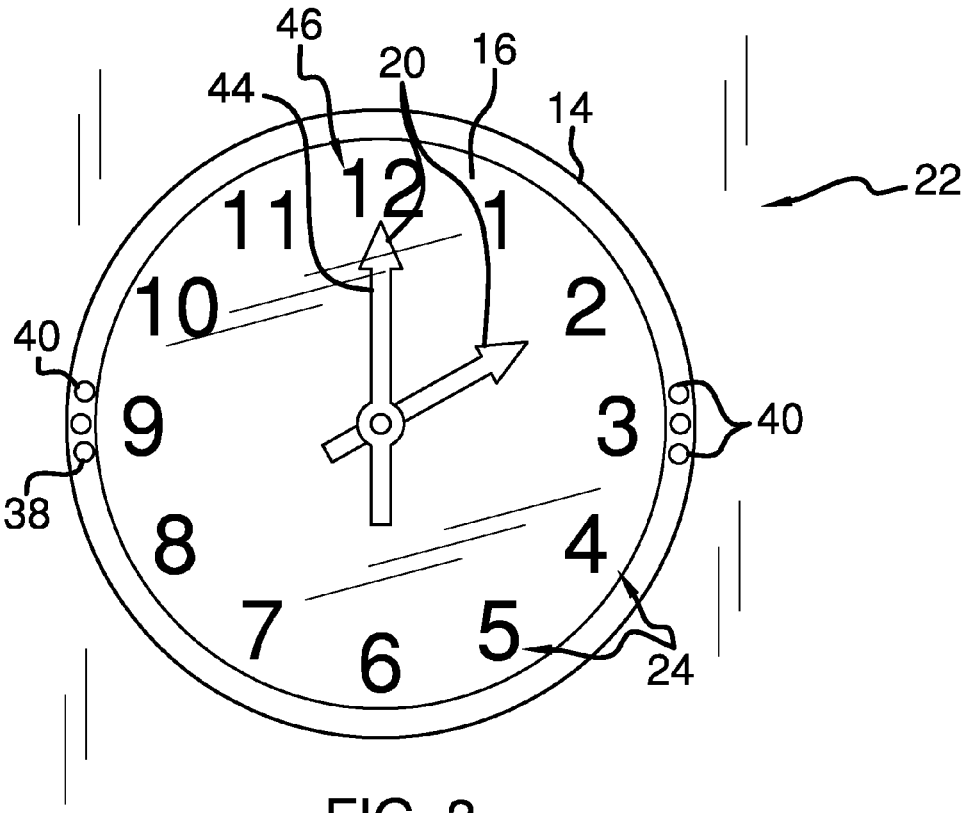
FIG. 3 is a front view of an embodiment of the disclosure.
Figure 4:
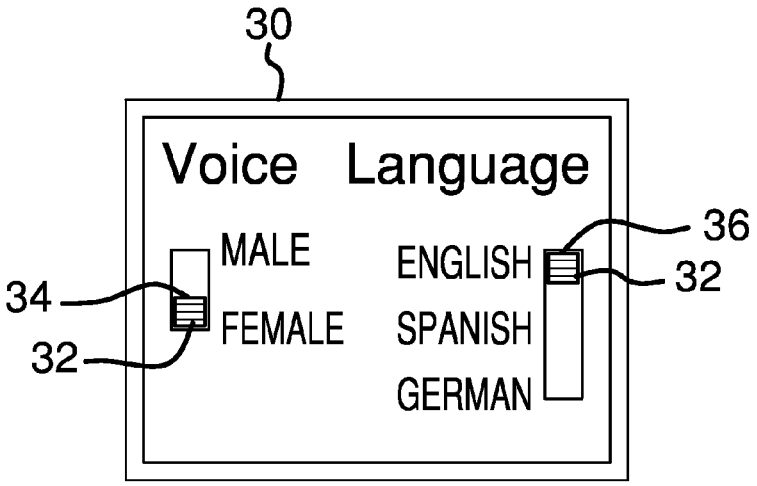
FIG. 4 is a front view of a control of an embodiment of the disclosure.
Figure 5:
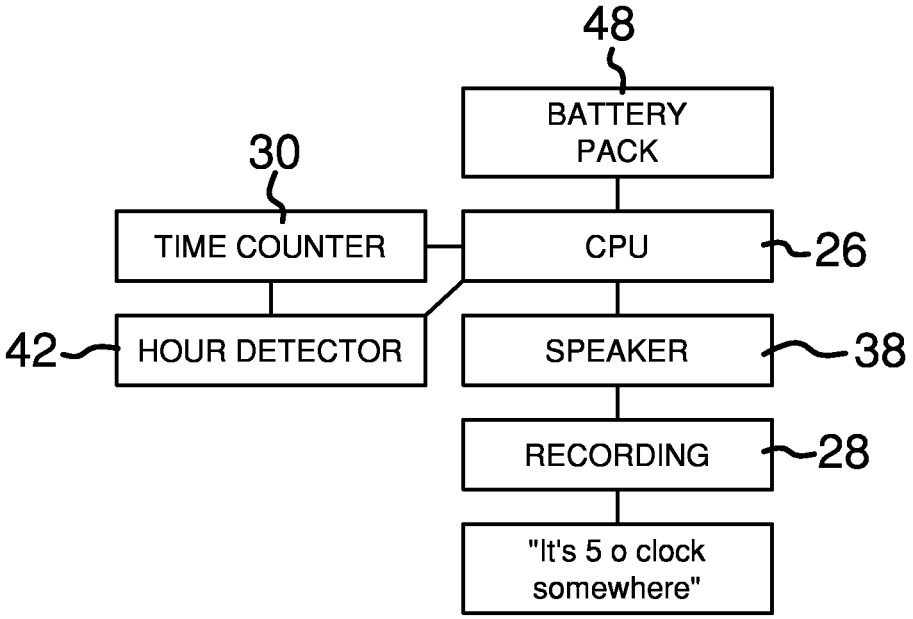
FIG. 5 is a schematic view of an embodiment of the disclosure.

With reference now to the drawings, and in particular to FIGS. 1 through 5 thereof, a new chronograph device embodying the principles and concepts of an embodiment of the disclosure and generally designated by the reference numeral 10 will be described.

As best illustrated in FIGS. 1 through 5, the chronograph assembly 10 generally comprises a clock 12. The clock 12 has an outer edge 14 extending between each of a front side 16 and a back side 18 of the clock 12. The clock 12 is structured to have a pair of hands 20 movably coupled to the front side 18 of the clock 12. The hands 20 may indicate a time of day.

The clock 12 may be coupled to a support surface 22. The support surface 22 may be a wall. The front side 16 of the clock 12 has indicia 24 printed thereon. The hands 20 sequentially point to the indicia 24. The indicia 24 comprise hours of the day.

A processor 26 is coupled to the clock 12. The processor 26 may be an electronic processor of any conventional design. An electronic memory 28 is coupled to the clock 12. The electronic memory 26 is electrically coupled to the processor 26. The electronic memory 26 stores a recorded audible message. The recorded audible message comprises the words "It's five o'clock somewhere".

A control 30 is coupled to the back side 18 of the clock 12. The control 30 is electrically coupled to the electronic memory 28. The control 30 comprises a pair of switches 32. A first one 34 of the switches 32 selects a gender of the recorded audible message. A second one 36 of the switches 32 selects a language of the recorded audible message. The languages may be English, German and Spanish.

A speaker 38 is coupled to the front side 16 of the clock 12 proximate the outer edge 14 of the clock 12. The speaker 38 directs an audible sound toward a user. The speaker 38 is electrically coupled to the processor 26. Additionally, the speaker 38 is one of a plurality of speakers 40. The plurality of speakers 40 is evenly distributed on opposite sides of the outer edge 14 of the clock 12.

A sensor 42 is coupled to the clock 12. The sensor 42 detects when a minute one 44 of the hands 20 points toward a trigger one 46 of the indicia 24. The trigger indicia 46 may be the number "12". The sensor 42 is electrically coupled to the processor 26. The processor 26 is actuated when the minute hand 44 points toward the trigger indicia 46. The speaker 38 emits the recorded audible message when the minute hand 44 points toward the trigger indicia 46.

A power supply 48 is coupled to the clock 12. The power supply 48 is electrically coupled to the processor 26. The power supply 48 comprises at least one battery 50. A battery cover 52 is removably coupled to the back side 18 of the clock 12. The power supply 48 is positioned beneath the battery cover 52.

In use, the gender and the language of the recorded audible message are selected using the control 30. The speakers 38 emit the phrase "It's five o'clock somewhere" at the top of each hour. The assembly 10 is utilized for entertainment purposes.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A chronograph assembly comprising:

a clock structured to have a pair of hands indicating a time of day, said clock being coupled to a support surface;

a processor coupled to said clock;

an electronic memory coupled to said clock, said electronic memory being electrically coupled to said processor, said electronic memory storing a recorded audible message, said recorded audible message comprising the words "It's five o'clock somewhere";

a control coupled to said clock, said control being electrically coupled to said electronic memory such that said control selects an aural quality of said recorded audible message;

a speaker coupled to said clock, said speaker being electrically coupled to said processor; and a sensor coupled to said clock such that said sensor detects a position of said hands on said clock, said sensor being electrically coupled to said processor such that said processor is actuated when said hands are positioned in a trigger position, said speaker emitting said recorded audible message when said hands are positioned in said trigger position.

2. The assembly according to claim 1, further comprising said clock having an outer edge extending between each of a front side and a back side of said clock.

3. The assembly according to claim 2, further comprising said hands being movably coupled to said front side of said clock.

4. The assembly according to claim 3, further comprising said front side of said clock having indicia printed thereon such that said hands sequentially point to said indicia, said indicia comprising hours of the day.

5. The assembly according to claim 2, further comprising said speaker being coupled to said front side of said clock proximate said outer edge of said clock such that said speaker directs an audible sound toward a user.

6. The assembly according to claim 1, further comprising:

a front side of said clock having indicia printed thereon; and said sensor detecting when a minute one of said hands points toward a trigger one of said indicia.

7. The assembly according to claim 1, further comprising a power supply coupled to said clock.

8. The assembly according to claim 7, further comprising said power supply being electrically coupled to said processor.

9. The assembly according to claim 8, further comprising said power supply comprising at least one battery.

10. A chronograph assembly comprising:

a clock, said clock having an outer edge extending between each of a front side and a back side of said clock, said clock being structured to have a pair of hands movably coupled to said front side of said clock wherein said hands are configured to indicate a time of day, said clock being coupled to a support surface;

said front side of said clock having indicia printed thereon such that said hands sequentially point to said indicia, said indicia comprising hours of the day;

a processor coupled to said clock;

an electronic memory coupled to said clock, said electronic memory being electrically coupled to said processor, said electronic memory storing a recorded audible message, said recorded audible message comprising the words "It's five o'clock somewhere";

a control coupled to said clock, said control being electrically coupled to said electronic memory such that said control selects an aural quality of said recorded audible message;

a speaker coupled to said front side of said clock proximate said outer edge of said clock such that said speaker directs an audible sound toward a user, said speaker being electrically coupled to said processor;

a sensor coupled to said clock such that said sensor detects when a minute one of said hands points toward a trigger one of said indicia, said sensor being electrically coupled to said processor such that said processor is actuated when said hands are positioned in a trigger position, said speaker emitting said recorded audible message when said minute hand points toward said trigger indicia; and a power supply coupled to said clock, said power supply being electrically coupled to said processor, said power supply comprising at least one battery.

* * * * *